US006567528B1

(12) United States Patent
Heed

(10) Patent No.: US 6,567,528 B1
(45) Date of Patent: May 20, 2003

(54) OFFSET APEX SPIDER

(75) Inventor: Thomas P. Heed, Greenwood, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 09/442,705

(22) Filed: Nov. 18, 1999

(51) Int. Cl.[7] ..... H04R 25/00

(52) U.S. Cl. ..... 381/404; 381/396; 381/412; 381/403; 181/166

(58) Field of Search ..... 381/396, 398, 381/404, 405, 412; 181/166, FOR 153, 171, 172

(56) References Cited

U.S. PATENT DOCUMENTS

| | | | | |
|---|---|---|---|---|
| 2,201,059 | A | | 5/1940 | Stephan |
| 2,295,483 | A | * | 9/1942 | Knowles |
| 3,930,129 | A | | 12/1975 | Cohen et al. |
| 4,146,756 | A | | 3/1979 | Kito et al. |
| 5,143,169 | A | * | 9/1992 | Ziegenberg |
| 5,715,324 | A | * | 2/1998 | Tanabe |
| 5,729,616 | A | | 3/1998 | Geisenberger |
| 5,909,499 | A | * | 6/1999 | Tanabe |
| 6,188,774 | B1 | * | 2/2001 | Sabato |
| 6,263,084 | B1 | * | 7/2001 | Cressman |
| 6,351,544 | B1 | * | 2/2002 | Noll |
| 6,449,375 | B1 | * | 9/2002 | Hutt |

FOREIGN PATENT DOCUMENTS

| | | |
|---|---|---|
| DE | 1001326 | 1/1957 |
| EP | 0685982 | 12/1995 |
| JP | 11127497 | 5/1999 |
| NL | 8204348 | 3/1983 |

* cited by examiner

*Primary Examiner*—Rexford Barnie
*Assistant Examiner*—Dionne Harvey
(74) *Attorney, Agent, or Firm*—Brinks Hofer Gilson & Lione

(57) ABSTRACT

An electrodynamic transducer includes a frame, a magnet assembly providing a magnetic field across an air gap, a voice coil, a coil former for supporting the voice coil in the air gap, and a diaphragm having an outer perimeter and an apex. The coil former is coupled to the apex so that current through the voice coil causing the voice coil to move in the air gap causes the diaphragm to move. A spider is coupled to the coil former to support the voice coil in the air gap. The spider has convolutions radially outward from the coil former. The convolutions include arcs and generally straight sections. A surround is coupled to the outer perimeter and the frame to support the outer perimeter from the frame. The surround has convolutions radially outward from the outer perimeter. The convolutions include arcs and generally straight sections. The generally straight sections may have non-uniform lengths and non-uniformly varying lengths with increasing distance from the coil former. The arcs may have non-uniform radii of curvature and non-uniformly varying radii of curvature with increasing distance from the coil former. The arcs may have non-uniform lengths and non-uniformly varying lengths with increasing distance from the coil former.

4 Claims, 2 Drawing Sheets

OFFSET APEX SPIDER

FIELD OF THE INVENTION

This invention relates to electrodynamic transducers. It is disclosed in the context of a moving coil loudspeaker, but is believed to have utility in other applications as well.

BACKGROUND OF THE INVENTION

Various loudspeaker constructions are known. There are, for example, the constructions illustrated and described in U.S. Pat. Nos. 2,201,059; 2,295,483; 3,930,129; 4,146,756; 5,715,324; and, 5,729,616. This listing is not intended as a representation that a thorough search of the prior art has been conducted or that no more pertinent art than that listed above exists, and no such representation should be inferred.

An audio loudspeaker typically includes a magnet structure which provides a magnetic field across an air gap, a voice coil in the magnetic field in the air gap, and a diaphragm coupled to the voice coil to be reciprocated by the voice coil as audio frequency signal flows in the voice coil. Typically, the diaphragm is suspended around its outer perimeter from a supporting frame by a so-called surround, usually a half roll compliance which permits relatively free reciprocation of the diaphragm along the axis of the voice coil. Typically the diaphragm and the voice coil are also supported at the perimetrally inner boundary, or apex of the diaphragm, by a spider. The voice coil is mounted on a coil former which is attached to the apex of the diaphragm. The inner perimeter of the spider is attached at its inner perimeter to the joined coil former/apex, and at its outer perimeter to the frame or the magnet assembly, typically around the junction of the frame and magnet assembly.

The spider is typically constructed from phenolic resin-impregnated textile or the like. The impregnated textile is dried to remove the carrier from the phenolic resin and then hot pressed in a mold to set convolutions into the spider. These convolutions provide the necessary compliance to permit the same relatively free reciprocation of the apex along the axis of the voice coil. The convolutions typically are in the form of curved sections and generally straight sections. The curved sections may be arcs of a circle in cross section radially of the spider and loudspeaker, or segments of other curves. These will all be referred to herein as arcs. These arcs are typically uniform or, in some cases, uniformly decreasing or uniformly increasing, from adjacent the coil former to adjacent the frame and/or magnet assembly.

DISCLOSURE OF THE INVENTION

According to the invention, the arcs are neither uniform nor uniformly decreasing or increasing from adjacent the coil former to adjacent the frame/magnet assembly.

Illustratively, the arcs' dimensions, for example, the lengths of circular arcs' radii, are arranged somewhat randomly (quasi-randomly) from adjacent the coil former to adjacent the frame/magnet assembly.

Illustratively, the lengths of the arcs themselves are arranged quasi-randomly from adjacent the coil former to adjacent the frame/magnet assembly.

According to the invention, the lengths of the generally straight sections which, in many spider designs, connect adjacent arcs are neither uniform nor uniformly decreasing or increasing from adjacent the coil former to adjacent the frame/magnet assembly.

Illustratively, the lengths of the generally straight sections are arranged quasi-randomly from adjacent the coil former to adjacent the frame/magnet assembly.

According to the invention, an electrodynamic transducer includes a magnet assembly providing a magnetic field across an air gap, a voice coil, a coil former for supporting the voice coil in the air gap, and a diaphragm having an outer perimeter and an apex. The coil former is coupled to the apex so that current through the voice coil causing the voice coil to move in the air gap causes the diaphragm to move. A spider is coupled to the coil former to support the voice coil in the air gap. The spider has convolutions radially outward from the coil former. The convolutions include arcs and generally straight sections.

According to one aspect of the invention, the generally straight sections are of non-uniform length and of non-uniformly varying length with increasing distance from the coil former.

According to another aspect of the invention, the arcs have non-uniform and non-uniformly varying radii of curvature with increasing distance from the coil former.

Illustratively according to this aspect of the invention, the non-uniform radii of curvature are different radii of curvature.

According to another aspect of the invention, the arcs are of non-uniform length and of non-uniformly varying length with increasing distance from the coil former.

According to the invention, an electrodynamic transducer includes a frame, a magnet assembly providing a magnetic field across an air gap, a voice coil, a coil former for supporting the voice coil in the air gap, and a diaphragm having an outer perimeter and an apex. The coil former is coupled to the apex so that current through the voice coil causing the voice coil to move in the air gap causes the diaphragm to move. A surround is coupled to the outer perimeter and the frame to support the outer perimeter from the frame. The surround has convolutions radially outward from the outer perimeter. The convolutions include arcs and generally straight sections.

According to another aspect of the invention, the generally straight sections are of non-uniform length and of non-uniformly varying length with increasing distance from the outer perimeter.

According to another aspect of the invention, the arcs have non-uniform and non-uniformly varying radii of curvature with increasing distance from the coil former.

Illustratively according to this aspect of the invention, the non-uniform radii of curvature are quasi-random radii of curvature.

According to another aspect of the invention, the arcs are of non-uniform length and of non-uniformly varying length with increasing distance from the outer perimeter.

BRIEF DESCRIPTION OF THE DRAWINGS

The invention may best be understood by referring to the following detailed description and accompanying drawings which illustrate the invention. In the drawings.

DETAILED DESCRIPTION OF ILLUSTRATIVE EMBODIMENTS

Figure 1:
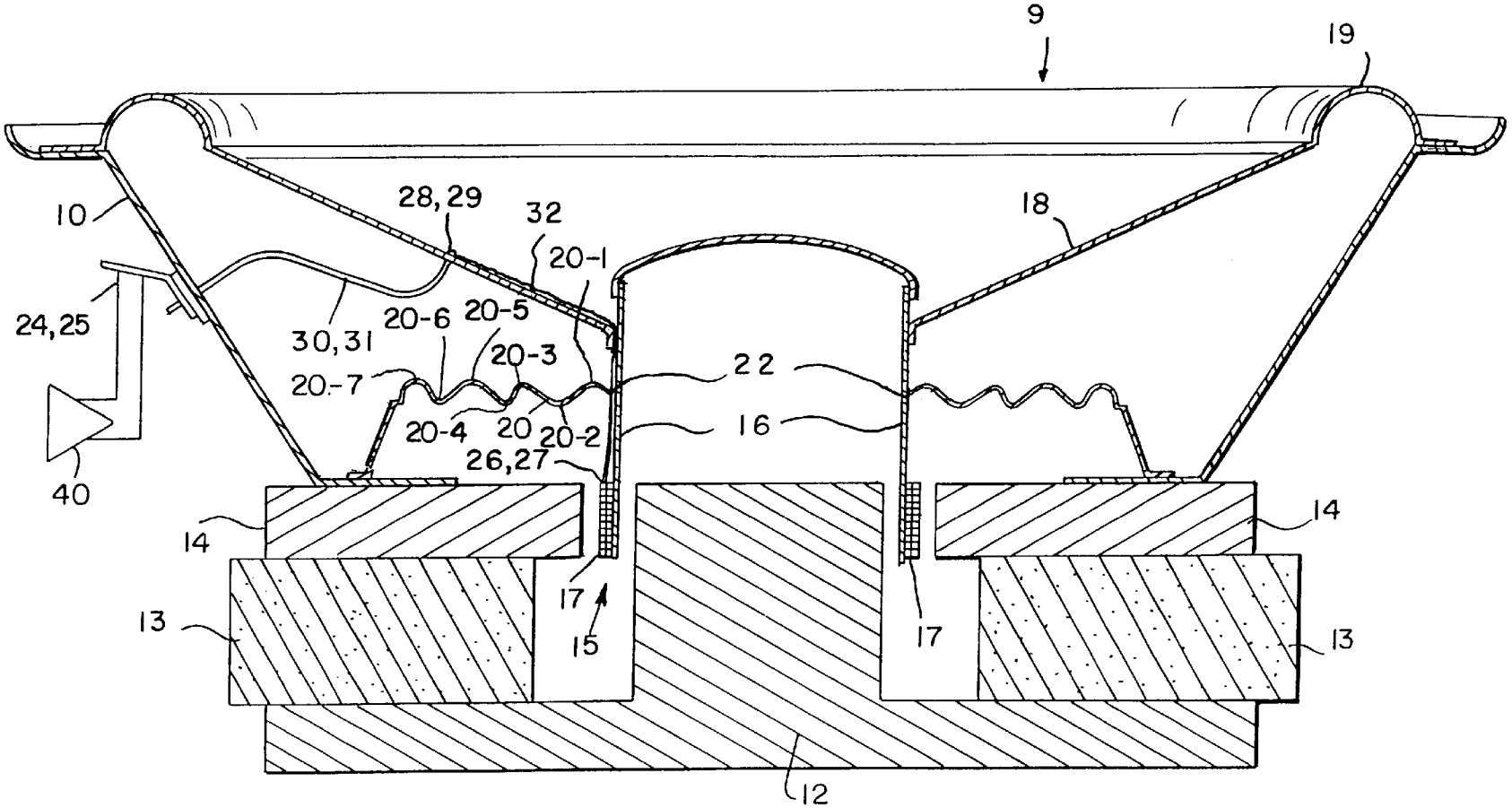
FIG. 1 illustrates a fragmentary cross-section through a loudspeaker constructed according to the invention.
Figure 2:
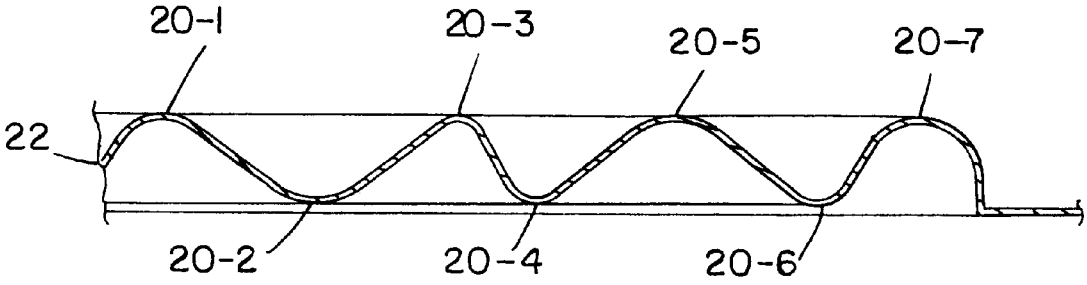
FIG. 2 illustrates an enlarged fragmentary view of a detail of the loudspeaker illustrated in FIG. 1; and, FIG. 3 illustrates an enlarged detail of a fragmentary cross-section through another loudspeaker constructed according to the invention.

Referring now to FIGS. 1–2, a loudspeaker 9 includes a supporting frame 10 and a motor assembly. The illustrated motor assembly includes a backplate/center pole 12, a permanent magnet 13, and a front plate 14 providing a substantially uniform magnetic field across an air gap 15. A voice coil former 16 supports a voice coil 17 in the magnetic field. Current from an amplifier 40 related to the program material to be transduced by the loudspeaker 9 drives the voice coil 17, causing it to reciprocate axially in the air gap 15 in a known manner. A cone 18 attached at its apex to an end of the coil former 16 lying outside the motor assembly 12, 13, 14 is coupled by a surround 19 at its outer perimeter to the frame 10. A spider 20 is coupled at its outer perimeter to the frame 10. The spider 20 includes a central opening 22 to which the voice coil former 16 is attached. The suspension including the surround 19 and spider 20 constrains the voice coil 17 to reciprocate axially in the air gap 15.

A typical, although by no means the only, mechanism for completing the electrical connection between the loudspeaker terminals 24, 25 and the voice coil wires 26, 27 is illustrated in FIG. 1. The voice coil wires 26, 27 are dressed against the side of the coil former 16, and pass through central opening 22 and the intersection of the coil former 16 and the apex of the cone 18. Wires 26, 27 are then dressed across the face 32 of the cone 18 to the points 28, 29 on the face of the cone 18 where they are connected to the flexible conductors 30, 31. Connections 28, 29 are made by any of a number of available techniques. The coil wires 26, 27 illustratively are fixed to the face 32 of the cone 18 with (an) electrically non-conductive adhesive(s).

The spider 20 has non-uniformly, quasi-randomly spaced, quasi-random length curved sections, or arcs, 20-1–20-7. This reduces loudspeaker applied force versus deflection non-linearities, thereby reducing distortion caused by non-linear motion of the voice coil 17 and coil former 16 at low frequencies. The spider 20 of the invention may be used with a flat outer foot configuration where the spider 20 is coupled at its outer perimeter to the frame 10 and/or motor assembly 12, 13, 14, or with the illustrated cupped outer foot configuration where the spider 20 is coupled at its outer perimeter to the frame 10 and/or motor assembly 12, 13, 14. The spider 20 of the invention may be used with a "neck-up" attachment of the central opening 22 of spider 20 to the coil former 16 or with the illustrated "neck-down" attachment of the central opening 22 of spider 20 to the coil former 16. The spider 20's compliance is more linear over the full range of deflection of the spider 20 as the voice coil 17 moves in the air gap 15. Non-linear distortion is thereby decreased.

The illustrated spider 20 has the following dimensions: radius of the central opening 22, 13.13 mm, radius from the centerline of central opening 22 to the radius of curvature of the radially innermost arc 20-1 in the plane of FIG. 1, 14.75 mm; radius of curvature of arc 20-1, 1.42 mm; radius to the radius of curvature of arc 20-2 in the plane of FIG. 1, 18.75 mm; radius of curvature of arc 20-2, 1.87 mm; radius to the radius of curvature of arc 20-3 in the plane of FIG. 1, 22.4 mm; radius of curvature of arc 20-3, 0.69 mm; radius to the radius of curvature of arc 20-4 in the plane of FIG. 1, 24.4 mm; radius of curvature of arc 20-4, 0.69 mm; radius to the radius of curvature of arc 20-5 in the plane of FIG. 1, 28.00 mm, radius of curvature of arc 20-5, 1.87 mm; radius to the radius of curvature of arc 20-6 in the plane of FIG. 1, 31.69 mm; radius of curvature of arc 20-6, 0.94 mm; radius to the radius of curvature of arc 20-7 in the plane of FIG. 1, 34.45 mm, and, radius of curvature of arc 20-7, 1.6 mm. The radii of curvature of arcs 20-1–20-7 are to the center of the thickness of the material from which the spider 20 is constructed. Such a construction results in the generally straight sections of the spider 20 between the arcs 20-1–20-7 being of non-uniform length as well.

Figure 3:
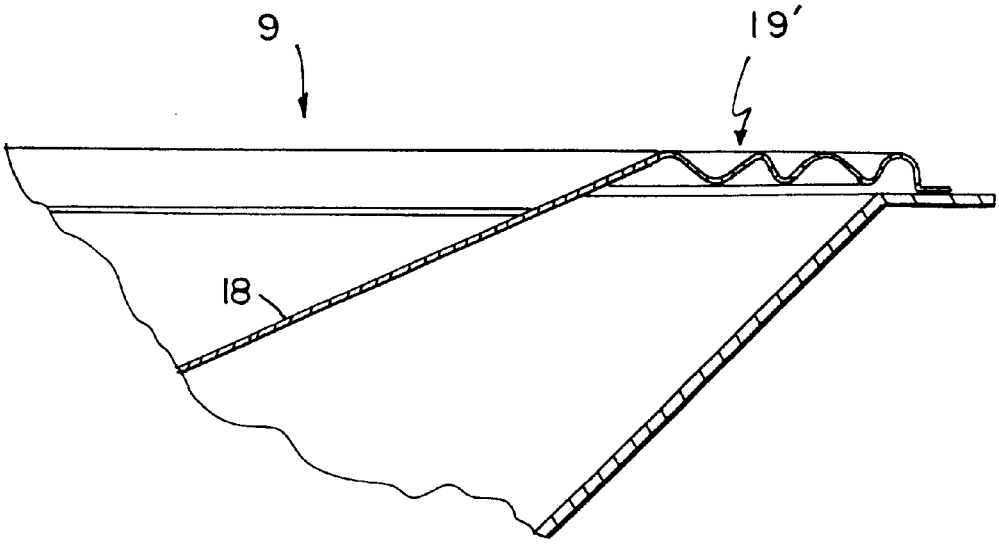

The non-uniformly, quasi-randomly spaced, quasi-random length arc configuration may also be employed on multi-roll loudspeaker cone 18 surrounds 19' as illustrated in FIG. 3.

What is claimed is:

1. An electrodynamic transducer including a magnet assembly providing a magnetic field across an air gap, a voice coil, a coil former for supporting the voice coil in the air gap, a diaphragm, the coil former coupled to the diaphragm so that current through the voice coil causing the voice coil to move in the air gap causes the diaphragm to move, and a spider coupled to the coil former to support the voice coil in the air gap, the spider having convolutions radially outward from the coil former, the convolutions being of uniform height, the convolutions including arcs and generally straight sections, the generally straight sections being of non-uniform length and of non-uniformly varying length with increasing distance from the coil former.

2. An electrodynamic transducer including a magnet assembly providing a magnetic field across an air gap, a voice coil, a coil former for supporting the voice coil in the air gap, a diaphragm, the coil former coupled to the diaphragm so that current through the voice coil causing the voice coil to move in the air gap causes the diaphragm to move, and a spider coupled to the coil former to support the voice coil in the air gap, the spider having convolutions radially outward from the coil former, the convolutions being of uniform height, the convolutions including arcs having non-uniform radii of curvature and non-uniformly varying radii of curvature with increasing distance from the coil former.

3. The apparatus of claim 2 wherein the non-uniform radii of curvature are different radii of curvature.

4. An electrodynamic transducer including a magnet assembly providing a magnetic field across an air gap, a voice coil, a coil former for supporting the voice coil in the air gap, a diaphragm, the coil former coupled to the diaphragm so that current through the voice coil causing the voice coil to move in the air gap causes the diaphragm to move, and a spider coupled to the coil former to support the voice coil in the air gap, the spider having convolutions radially outward from the coil former, the convolutions being of uniform height, the convolutions including arcs of non-uniform length and of non-uniformly varying length with increasing distance from the coil former.

* * * * *